United States Patent [19]

Plaessmann

[11] 4,072,117

[45] Feb. 7, 1978

[54] CANISTER INDEXING SPOUT-INSERTING MACHINE

[75] Inventor: Frederick August Plaessmann, Edison, N.J.

[73] Assignee: Seal-Spout Corporation, Liberty Corner, N.J.

[21] Appl. No.: 723,476

[22] Filed: Sept. 15, 1976

[51] Int. Cl.[2] ..... B21D 39/00

[52] U.S. Cl. ..... 113/1 H; 29/714; 113/121 E; 198/394

[58] Field of Search ..... 113/1 R, 1 G, 1 H, 121 E; 53/281, 367, 76; 198/394, 344; 29/714

[56] References Cited

U.S. PATENT DOCUMENTS

| | | | |
|---|---|---|---|
| 2,528,912 | 11/1950 | Rappaport et al. | 198/394 |
| 2,998,788 | 9/1961 | Back et al. | 113/1 H |
| 3,381,645 | 5/1968 | Klausmann | 113/1 H |
| 3,601,881 | 8/1971 | Seidewitz | 29/714 |
| 3,633,765 | 1/1972 | Bennett | 53/281 X |
| 3,977,154 | 8/1976 | Kamisaka et al. | 53/281 X |
| 3,996,724 | 12/1976 | Smith | 53/76 |

*Primary Examiner*—Leon Gilden
*Attorney, Agent, or Firm*—Edward R. Weingram

[57] ABSTRACT

A machine for inserting a pouring spout at a precise, predetermined position on a canister wall, which machine consists of a first holding means that releasably holds a canister on a carriage that moves in a discontinuous manner through a series of work stations. At one of the work stations, the canister is temporarily released by the first holding means and captured by second holding means associated with a turntable that is rotatably positioned by means responsive to a control signal generated from scanning means at the work station, which sense the position of an indexing mark on the canister. After the turntable and the canister are positioned, the canister is released by the second holding means and carried by an elevator back to the carriage where the canister is held in the indexed position by the first holding means and continues through the remainder of the work stations. At subsequent work stations, pouring spouts in blank form are fed to a carrier positioned near the zone on the canister intended to receive the spout. A ram in the carrier acts to simultaneously form one spout from the blanks while synchronously coacting with a mandrel to push another formed spout through and secure it to the canister wall.

20 Claims, 17 Drawing Figures

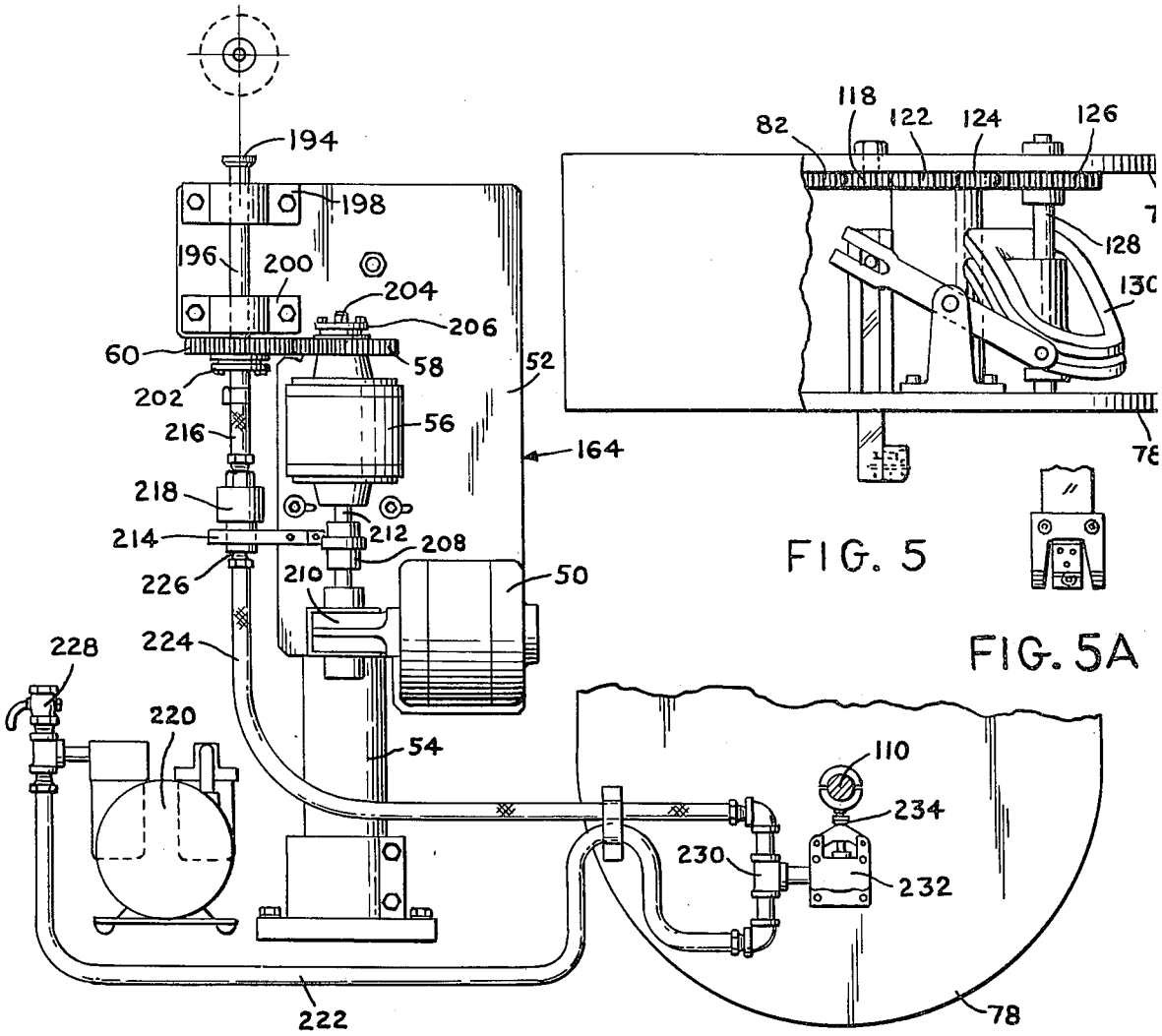
FIG. 7
FIG. 5
FIG. 5A
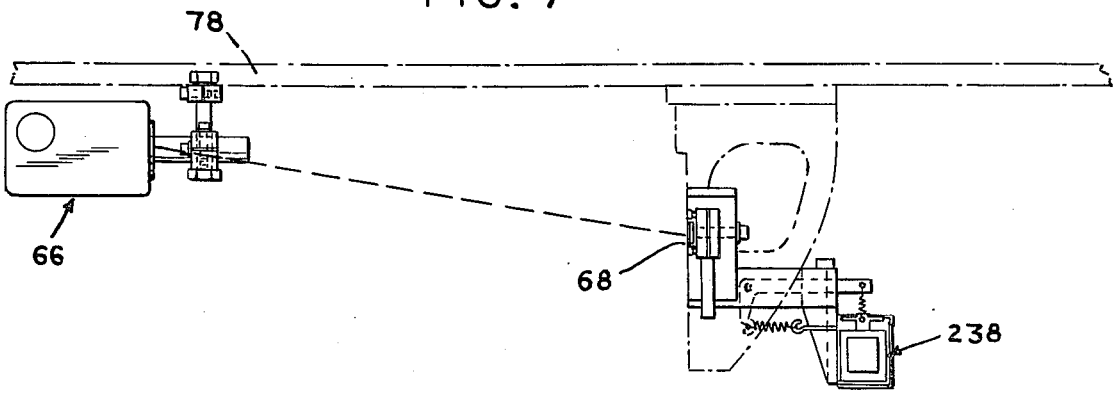
FIG. 8

CANISTER INDEXING SPOUT-INSERTING MACHINE

BACKGROUND OF THE INVENTION

1. Field of the Invention

This invention relates to machines for processing packaging containers and, more particularly, to a machine for receiving canisters, aligning them, and inserting a spout into a wall of each canister at a predetermined zone on each canister, and then discharging the canister. Further, the invention relates to machines of the type described in U.S. Pat. No. 3,025,813 dated Mar. 20, 1962, U.S. Pat. No. 3,381,645 dated May 7, 1968, U.S. Pat. No. 3,385,248 dated May 28, 1968, intended for the attaching of pouring spouts to containers (such as pouring spouts of the general type disclosed in U.S. Pat. No. 2,011,434 dated Aug. 13, 1935).

2. Description of the Prior Art

In machines for inserting pouring spouts into containers, there are usually one or more spout-feeding stations at which the spouts in blank form are fed successively, the blanks are bent to form body portions and sector-shaped wings in angular relation thereto and prongs are stamped from the body portion of the spouts. There are also one or more spout transfer and inserting units which move to pick up spouts at the spout-feeding station and transfer the spouts to a spout-inserting station. The containers are moved cynchronously with the spout transfer and inserting units, during which movement each spout is inserted into a portion of a container wall.

In some known machines, the containers are moved in a straight linear path in spaced apart relation on a conveyor. The wall of the container in which the spout is to be inserted is approximately perpendicular to the paths of the container and the spout-inserting unit. In other machines, the containers are mounted on a rotary conveyor by arms that are radially disposed on a vertical shaft. The containers move in an arcuate path with the walls to receive the spouts disposed radially to said arcuate path.

While such machines have proven reliable for inserting the spout securely in the container, they have been less than successful in accurately positioning the spout on the container. The accurate positioning of the spout presents many problems. It is dependent upon the tolerances to which the containers are produced, and is also affected by the shape of the container. For example, when containers are cylindrical in shape, it has heretofore been impossible to consistently insert a spout at a specific spot or zone in the container, at the normal operating speeds of the machine. Furthermore, even at speeds well below those at which these machines normally operated, positioning of the cylindrical containers often could not be uniformly achieved, and even when achieved, required an inordinate amount of handling of the containers.

Therefore, the producers of the products stored in the containers either had to settle for graphic displays which could tolerate having the spout positioned over a wide area of the container, or else accepted the fact that positioning of a spout would disrupt the graphic display.

SUMMARY OF THE INVENTION

The present invention provides a machine for inserting a pouring spout at a precise, predetermined position of a canister wall, which machine consists of a first holding means that releasably holds a canister on a carriage that moves in a discontinuous manner through a series of work stations. At one of the work stations, the canister is temporarily released by the first holding means and captured by second holding means associated with a turntable that is rotatably positioned by means responsive to a control signal generated from scanning means at the work station, which sense the position of an indexing mark on the canister. After the turntable and the canister are positioned, the canister is released by the second holding means and carried by an elevator back to the carriage where the canister is held in the indexed position by the first holding means and continues through the remainder of the work stations. At subsequent work stations, pouring spouts in blank form are fed to a carrier positioned near the zone on the canister intended to receive the spout. A ram in the carrier acts to simultaneously form one spout from the blanks while synchronously coacting with a mandrel to push another formed spout through and secure it to the canister wall.

Accordingly. in view of the above, it is an object of the present invention to provide a machine that is simple, relatively inexpensive, reliable and durable, for attaching spouts to canisters without requiring excessive handling.

It is another object of the present invention to provide a machine of this character with novel and improved means for mounting and moving the spout-inserting units in an endless course, whereby the spouts can be accurately and rapidly attached to or inserted into the walls of the canisters.

Still another object of the present invention is to provide a spout-inserting machine with novel and improved means for rotationally aligning canisters and conveying the aligned canisters to the spout-inserting mechanism.

Yet a further object of the present invention is to provide a spout-inserting machine with novel and improved means for inserting the pouring spout in a predetermined relationship with the graphic display on a canister.

Still another object of the present invention is to provide a machine in which the registration of spout to the printing on the canister is independent of the registration of the printing on the canister to the construction of the canister.

Still another object of the present invention is to provide a machine which can interrupt spout feed when there is an absence of a canister on the work station.

It is yet another object of the present invention to provide a machine having means for holding the canister by arms with light, yet positive contact, without crushing the canister or permitting slippage between the arms and the canister wall.

A further object of the present invention is to provide a machine for inserting spouts into canisters, which is compatible with other machines commonly used in package forming and filling.

It is still another object of the present invention to provide a machine for inserting spouts which shall be compatible with the installation thereon of package forming and filling accessories, including, but not limited to, labeling, imprinting and coding devices.

Other objects and advantages will be apparent from the following description of an embodiment of the invention, and the novel features will be particularly pointed out hereinafter in connection with the appended claims.

BRIEF DESCRIPTION OF THE DRAWINGS

The invention is described in conjunction with the following drawings:

FIG. 4A is an enlarged detailed side elevational veiw of a portion of FIG. 4 showing the face of the anvil block of the spout-inserting machine;

FIG. 5 is a side elevational view of a labeling device of FIG. 4;

FIG. 7 is a side elevational view of a canister registration device of the registration device assembly for the spout-inserting machine of FIG. 1;

FIG. 8 is a side elevational view of a no canister/ no spout assembly of the spout-inserting machine of FIG. 1;

DESCRIPTION OF THE PREFERRED EMBODIMENT

The inventor contemplates a novel combination of a carriage or turntable adapted to receive a conveyed succession of canisters, open at least at one end thereof and having an indexing mark thereon, further conveying the canisters in succession step-by-step with alternate periods of movements and rest past a series of predetermined points or work stations; a registration means disposed at a first one of the work stations for positioning each canister at a predetermined rotational alignment during a period of rest of the canister at the work station; and a spout-inserting mechanism disposed at a second one of the work stations for mounting a pouring spout on the wall of each canister body during a period of rest of the canister at the work station. Further combinations of the above with additional components disposed at other of the work stations for processing the canister are included, especially a labeling mechanism at yet another work station for applying a covering to the outer surface of the installed spout.

Figure 1:
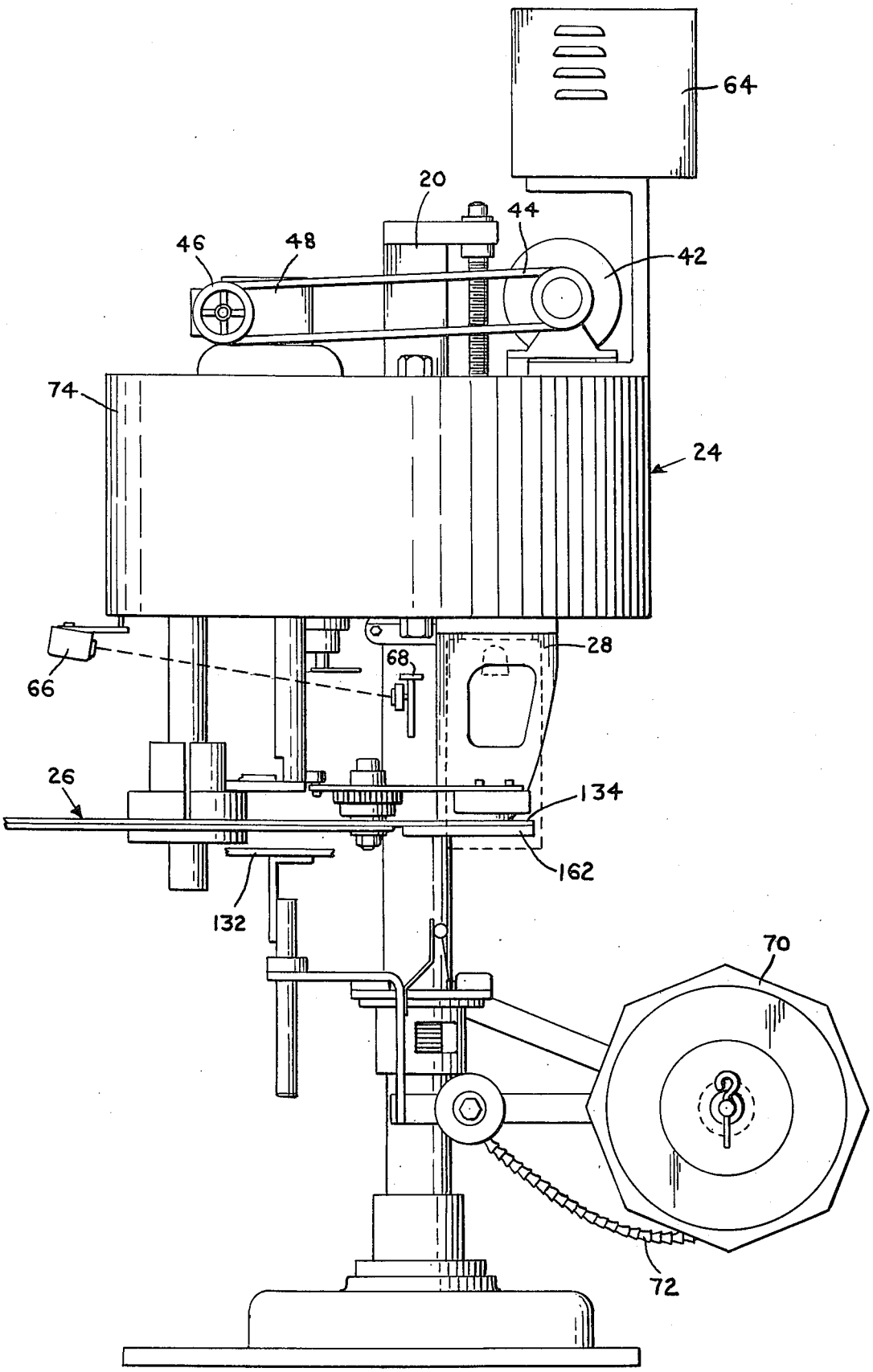
FIG. 1 is a front plan view of the spout-inserting machine embodying the present invention.
Figure 2:
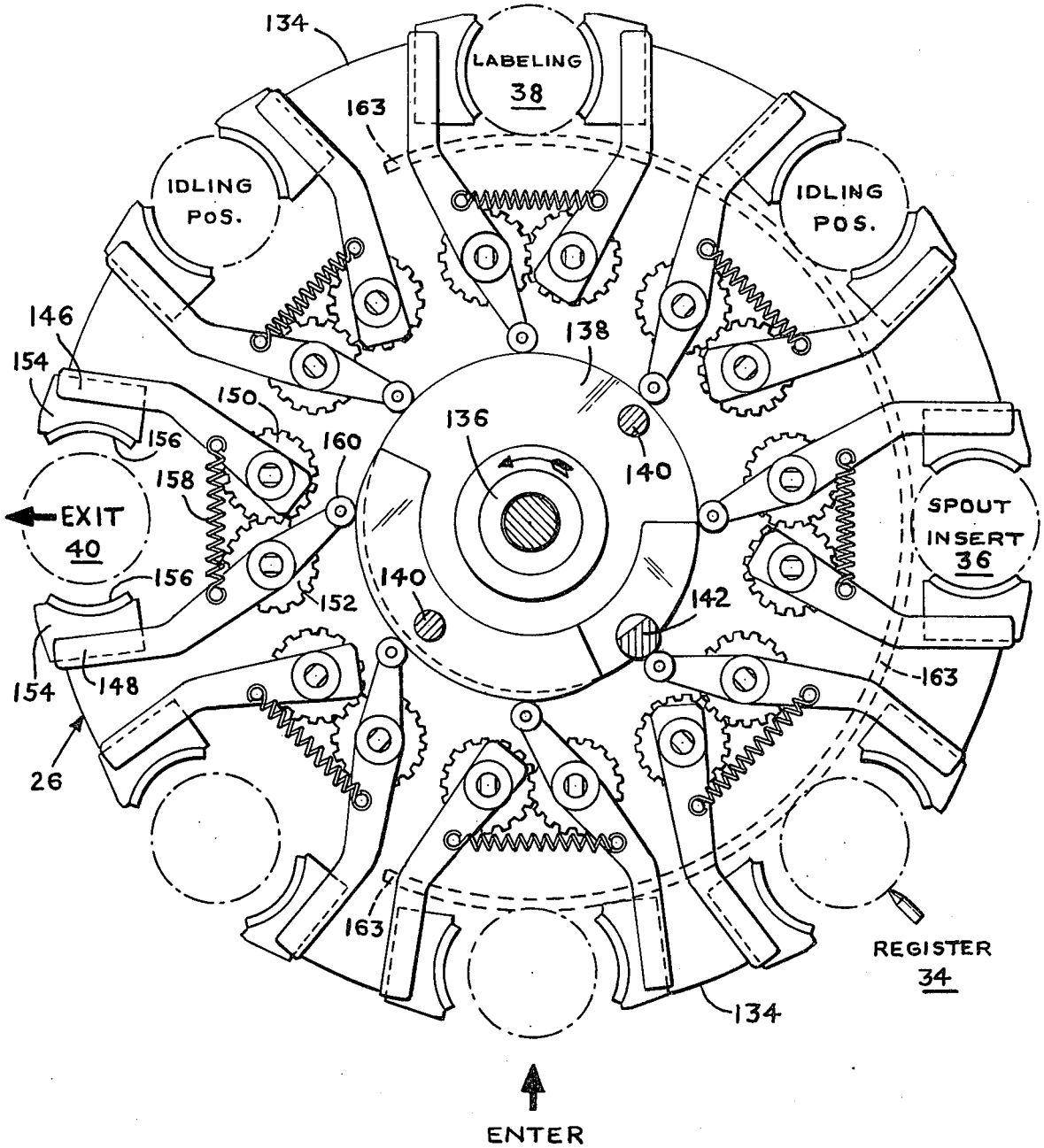
FIG. 2 is a top elevational view of a portion of the machine of FIG. 1 showing the work stations thereof.

In order to provide a general description of the preferred embodiment, reference is made to FIGS. 1 and 2. Specifically describing the illustrated embodiment of the invention, the machine includes suitable support which is shown in the form of main support or pedestal 20 having a base 22 and a drive mechanism housing 24. Supported on the pedestal is a carriage or turntable 26 for supporting and moving canisters 28 into which pouring spouts are to be mounted, the turntable is shown as rotatable about a vertical axis and having an individual holder or pair of arms generally indicated at 30 for each canister 28. The canister is moved in a predetermined path from a canister receiving or charging station 32, FIG. 2, thence to a canister registration station 34, thence to a spout-inserting station 36, thence to a canister labeling station 38, and finally, thence to a canister exiting or discharging station 40. As will be noted by examining FIG. 2, extra work stations are available for additional processing steps such as imprinting, encoding, additional labeling or the like.

Referring back to FIG. 1 other major components of the spout-inserting machine are in evidence. The main motive force for the machine is provided by electric motor 42 through motor pulley and drive belt 44, thence through reducer pulley 46 and gear reducer 48 which drives the drive mechanism described in detail below. Additionally, a secondary source of motive force is provided by ratio motor 50 mounted on mounting plate 52 which in turn is mounted on a second pedestal or center column 54. The motor 50 is employed in the process performed at registration station 34 and is in cooperative functional relationship with clutch/brake unit 56 and associated drive spur gears 58 and driven spur gear 60. The motor 50 and clutch/brake unit 56 are under the control influence of scanner 62 and associated indexing mark detection unit 64.

Further, FIG. 1 shows various major components that are operative at the spout-inserting station 36. The photoelectric control unit 66 which coacts with a retro-reflector mirror 68 causes no spout to be delivered when no canister is present at spout-inserting station. A reel 70 of pouring spout blanks 72 is shown leading into the working mechanism of the machine, to be described later.

Figure 3:
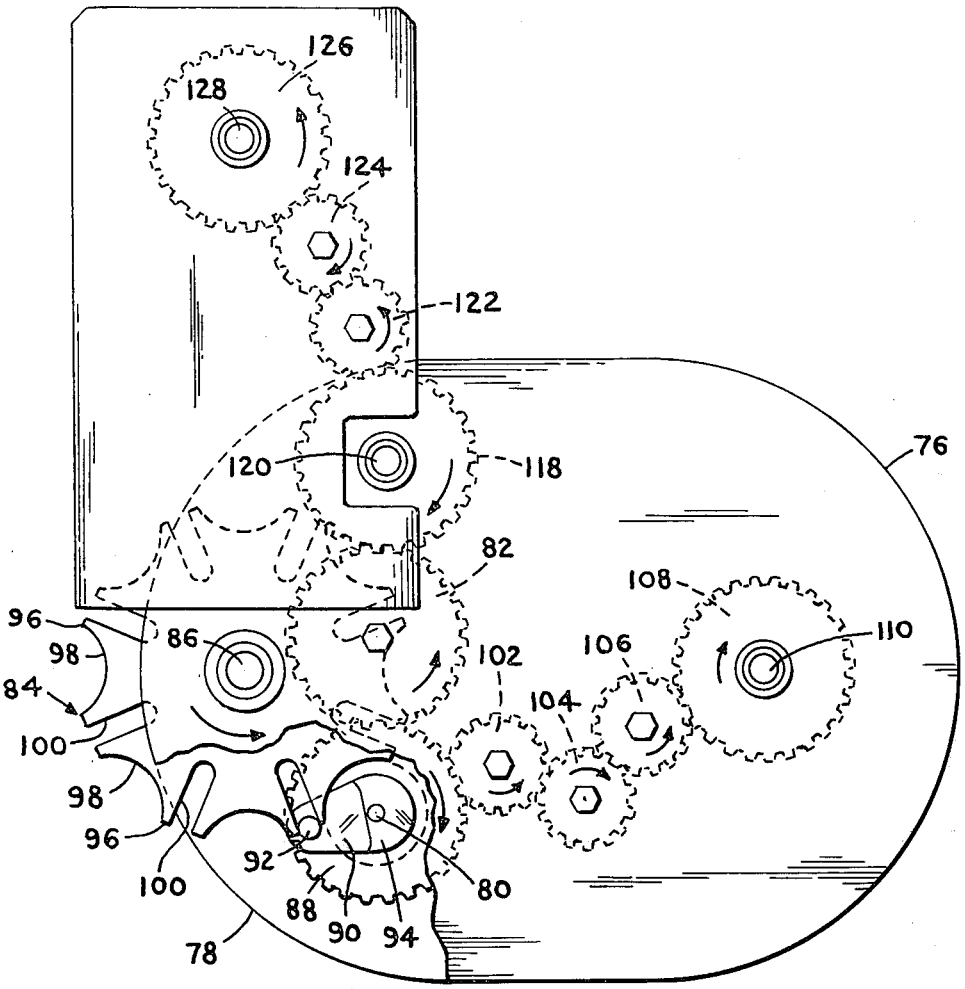
FIG. 3 is a horizontal sectional view on the plane of line 3—3 of FIG. 4 showing a gear train arrangement.
Figure 4:
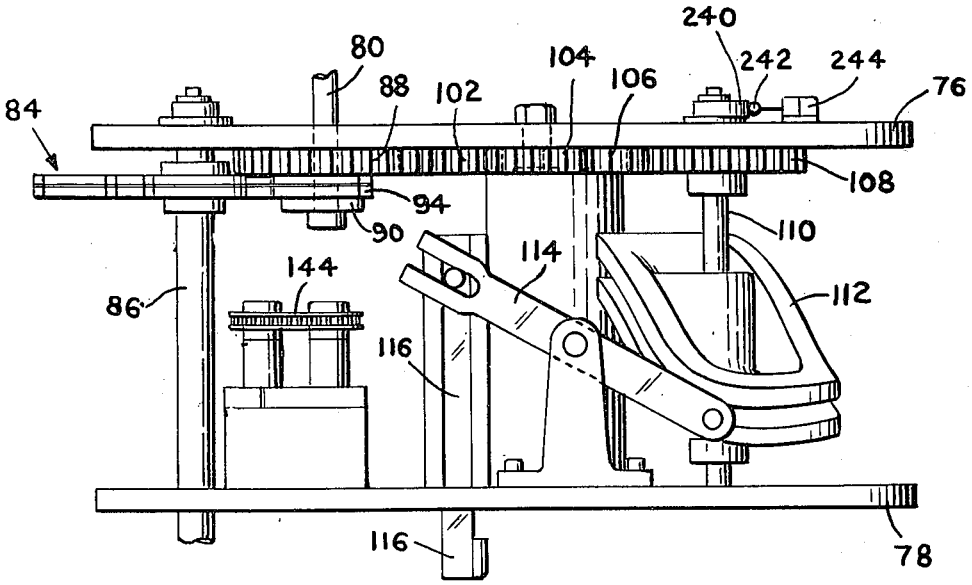
FIG. 4 is a side elevational view of a drive mechanism for the spout-inserting machine of FIG. 1.

Referring now to FIGS. 3 and 4, the drive mechanism is illustrated in detail. The mechanism includes cover 74, FIG. 1, that is mounted on upper plate 76, FIG. 3, and lower plate 78. The output shaft 80 of gear reducer 48 is connected to an idler gear 82 via gear 88 which is mounted adjacent the lower surface of upper plate 76. The mechanism provides the previously mentioned alternate periods of movement and rest to the machine by suitable means which is shown as including the driven portion of 8-point Geneva gear, generally indicated at 84, mounted on Geneva-gear shaft 86 journaled in the upper plate. The lower end of shaft 86 supports and drives carriage 26. Shaft 86 is driven through crank arm gear 88 which carries crank arm 90, with cam follower 92 and locking disc 94 thereon. The mechanism is adapted to move the crank arm one revolution with each revolution of the output shaft 80 and, therefore, to move the carriage 26 one-eighth revolution. To prevent overtravel of each point 96 of the Geneva gear the locking disc 94 meshes with arcuate outer portions 98 thereof to position the Geneva gear point so that the cam follower 92 coacts accurately with Geneva-gear drive channel 100.

For synchronized operation with the Geneva mechanism described above, various cam shafts are driven through the gear train from gear 88. In one direction, a series of spur gears 102, 104 and 106, journaled on upper plate 70 are adapted to drive a driven gear 108 mounted on spout-inserting mechanism drive shaft 110 which in turn drives the spout-inserting mechanism. The shaft 110 also carries a barrel cam 112, for operating rocker arm 114 and reciprocally moving mandrel 116, the structure of which will be described in detail below. In another direction, a series of spur gears, including idler 82, spur gear 118 mounted on elevator power takeoff shaft 120, and idler gears 122 and 124 journaled in upper plate 76, drive a driven gear 126 mounted on labeling mechanism drive shaft 128. The shaft 128 carries a barrel cam 130 for operating the labeling rocker arm and mandrel described in detail below.

Figure 6:
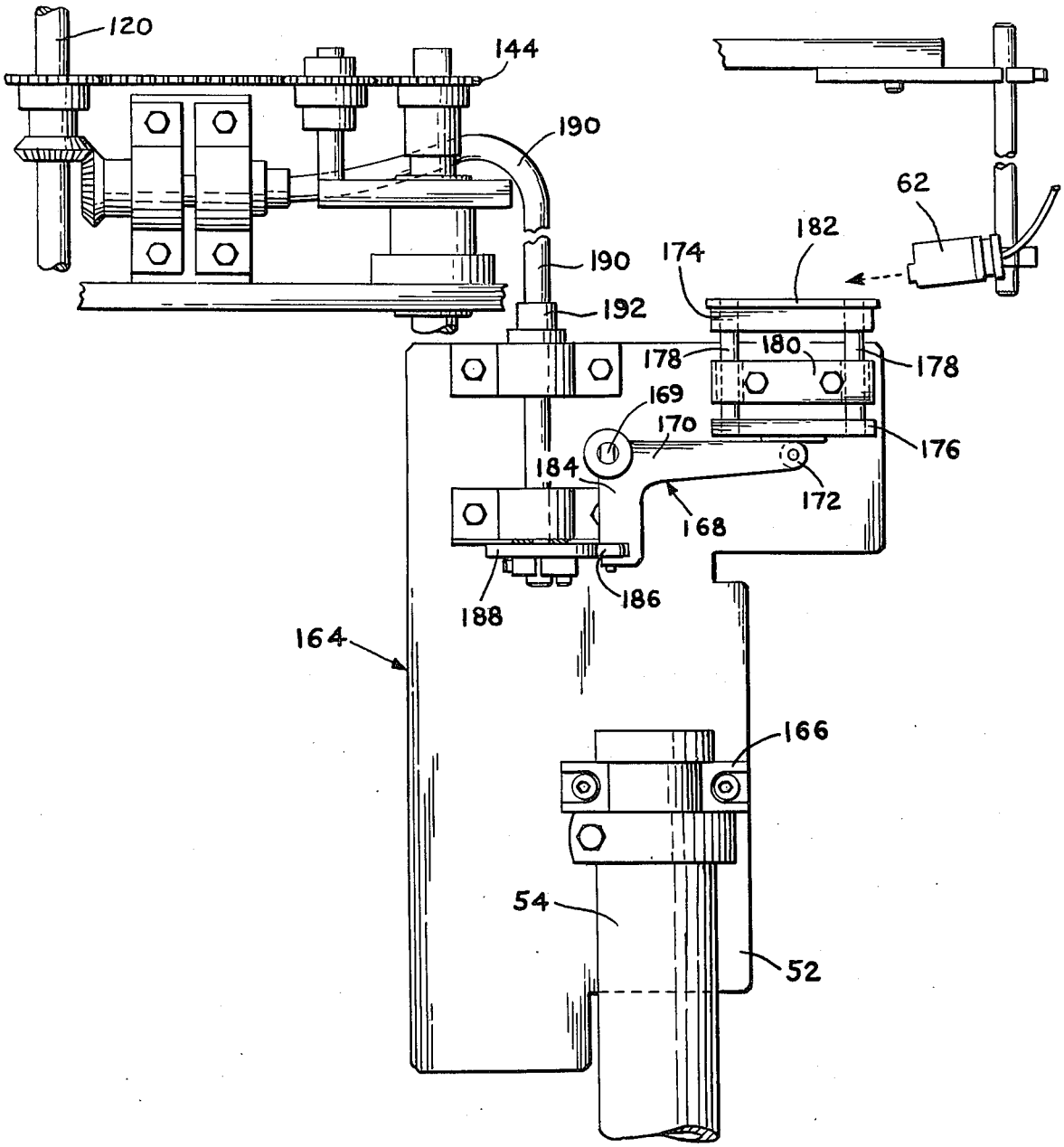
FIG. 6 is a side elevational view of a canister elevator mechanism of the registration device assembly of the spout-inserting machine of FIG. 1.
Figure 9:
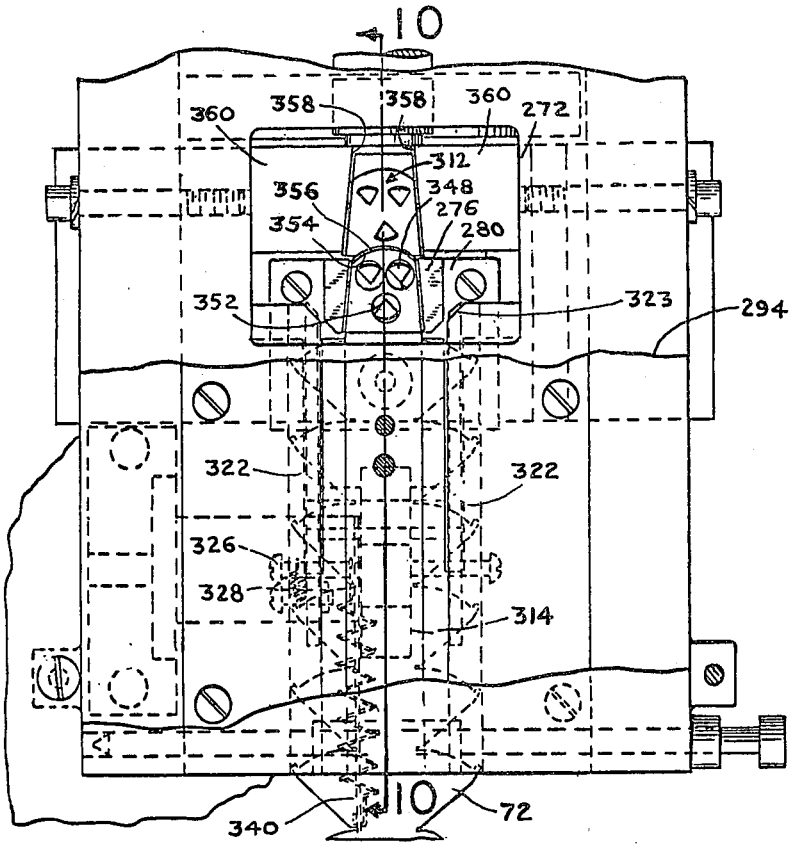
FIG. 9 is a side elevational view of the portion of a spout-inserting mechanism of the machine of FIG. 1 immediately before attachment of the spout to the canister as shown in FIG. 10 and showing portion of the side plate removed for clearness in illustration.
Figure 13:
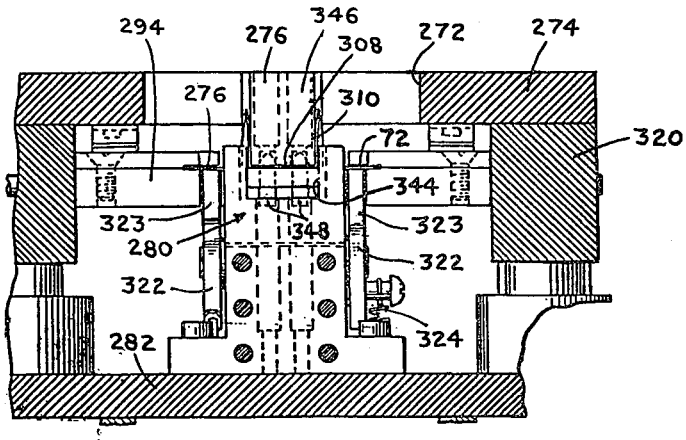
FIG. 13 is a fragmentary transverse vertical sectional view on the plane of the line 13—13 of FIG. 10.
Figure 10:
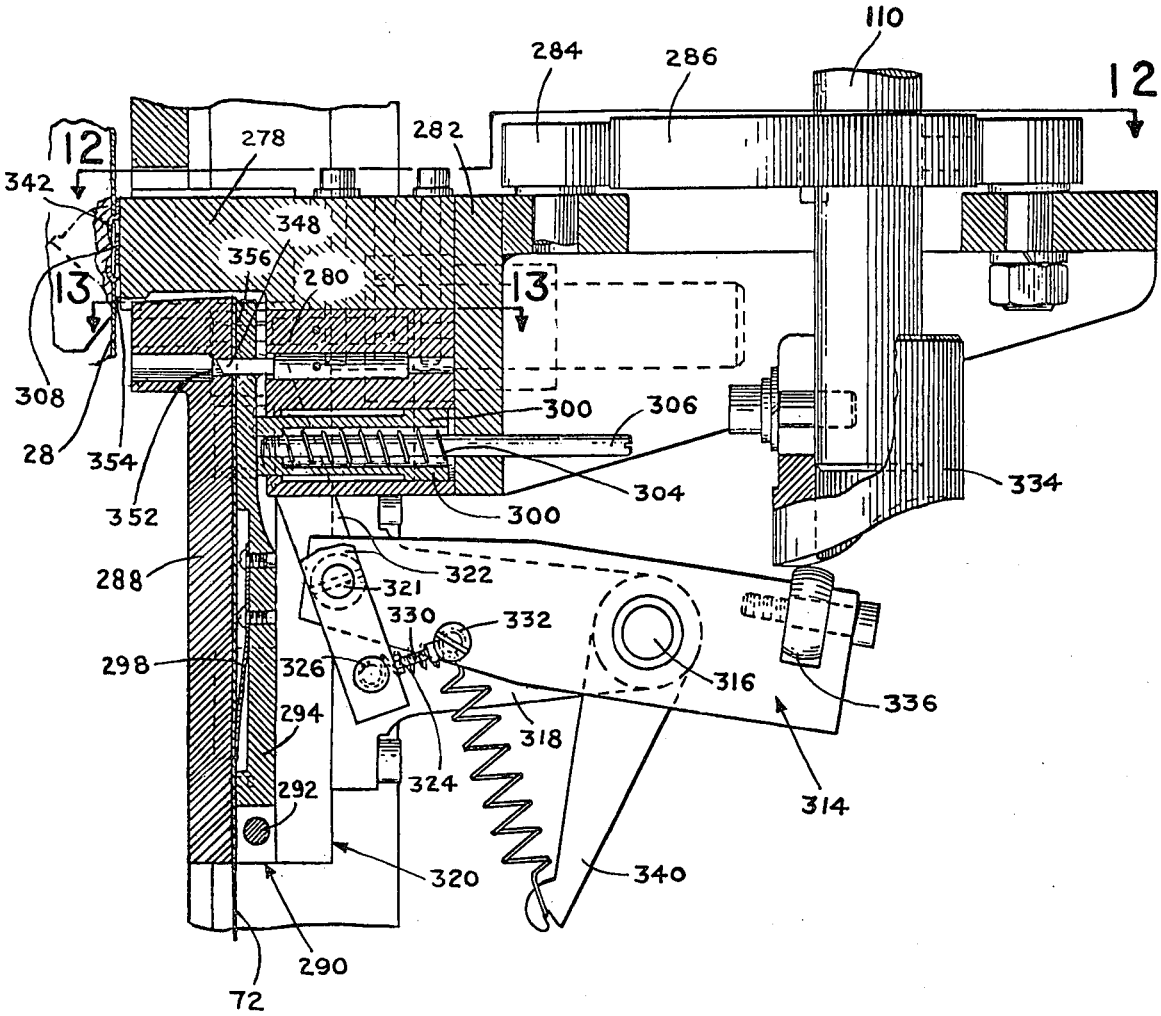
FIG. 10 is a fragmentary vertical sectional view of a spout-forming and spout-inserting mechanism taken along line 10—10 of FIG. 9, showing the dies and the ram in their respective spout-forming and spout-inserting positions.

Referring now to FIGS. 1, 2 and 3, the carriage or turntable 26 and associated mechanical structure are shown in detail. The carriage is in large part suspended from lower plate 78 by various posts and shafts. However, a stationary canister platform 132, partially shown in FIG. 1, is horizontally disposed below the carriage 26 and supported by a bracket from column 54. The carriage mechanism is shown as including a rotatable canister plate 134 suspended from canister plate drive shaft 86, the plate being clamped to the shaft by plate clamping hub 136. The mechanism further includes a stationary cam disc 138 having a cam segment 139 supported by cam posts 140 that depend from lower plate 78. Associated with stationary cam 138 in the part thereof adjacent the canister registration station 34 is a shaft cam 142 which is driven by a chain drive 144 from elevator power takeoff shaft 120. (See FIG. 6). At each work station, shown in FIG. 2, there is a canister handling means for releasably holding the sidewall of the canister. While great variations of handling means can be designed by those skilled in the machine arts, the particular arrangement of the preferred embodiment herein includes a pair of coacting canister arms 146 and 148 at each work station, radially disposed about stationary cam 138 and being mounted on the carriage 26 through respective mating canister arm spur gears 150 and 152. On the outermost portions of the arms are mounted canister blocks 154 and foam-rubber liners 156 for grasping the canisters. The arms 146 and 148 are biased toward each other by canister arm spring 158. The right-hand canister arm 148 is constructed to extend inwardly from spur gear 152 and includes a cam follower 160 for tracing stationary cam 138 and shaft cam 142. Besides the protection afforded the canister by liners 146, the canister is further protected from contact with metal surfaces by a teflontype plastic insert 162 (FIG. 1) disposed below canister plate 134 and canister guard rail 163 disposed medially between the lower plate 78 and the canister plate 134 and about the centrally disposed shafts and posts.

With the foregoing descriptions of the drive mechanism and the carriage assemblies borne in mind, the following description of the registration mechanism as related to the machine assembly becomes more readily comprehensible.

Upon reaching the canister registration work station, the canister with an indexing mark thereon is released from the canister arms 146 and 148 onto the registration device assembly referred to generally as 164 by means of the rotation of shaft cam 142 which coacts with cam followers 160 to open canister arms 148 and 146.

The registration device assembly receives the canister dropped by canister arms 164 and 148, rotates the canister while releasably holding it on a rotatable member, detects the indexing mark on the canister to stop the rotatable member in response thereto, releases the canister back to its initial height on the carrier, and re-engages the canister arms about the canister for delivering the properly positioned canister to the next work station in the registered orientation.

The registration apparatus is mounted on a plate 52 secured to post 54 by clamp 166. On the clamp side of the plate is shown an L-shaped rocker arm 168, the corner of which is fastened in a freely pivotal manner by stud 169. The longer leg 170 of the rocker arm is constructed so as to lien in a substantially horizontal position and mounted on the end of the leg 170 opposite the stud 169 is a cam follower 172. Positioned above leg 170 on mounting plate 52 is a movable support arrangement 174 including a post block 176 with posts 178 thereon which reciprocally relate with post guide block 180. On the movable support, a canister elevator plate 182 is mounted for raising the canister from the registration station processing level to the top of the canister platform 132 level.

The shorter leg 184 of the rocker arm is coactive through roller 186 with an eccentric rocker arm cam 188 which is shown as being rotable by flexible shaft 190, the lower end of which is journaled in bearing 192 and attached to the eccentric cam 188.

On the side opposite the clamp side of plate 52, structural components adapted to rotate the canister, while releasably holding it, are mounted. A suction cup 194 is shown as being mounted on vacuum shaft 196 which in turn is attached to mounting plate 52 through brakets 198 and 200. At the lower end of vacuum shaft 196 is attached driven spur gear 60 by bushing 202 for engagement with drive spur gear 58 mounted on output shaft 204 of clutch/brake unit 56 by bushing 206. The drive train of motor 50, clutch 56, drive gear 58 and driven gear 60 further includes a mechanical connection through a flexible coupling 208 of the output shaft 210 of the motor to input shaft 212.

Returning to vacuum shaft 196, further rotating elements are mounted between bushing 202 and a pressure joint bracket 214. Depending from the bushing 202 there is an attached pressure hose 216. For the purpose of providing a vacuum supply to suction cup 194 in a controlled manner, a vacuum pump 220 is mounted on base 22 with the suction part of the vacuum pump connected by vacuum hoses 222 and 224 through vacuum control means to the stationary portion 226 of rotating pressure joint 218.

The control means at the vacuum pump end of hose 222 is a gas cock 228 mounted on the vacuum pump, which cock is for regulating the suction by drawing ambient air into the line. The other ends of hoses 222 and 224 are T-connected through tee 230 to valve 232 which are mounted on lower plate 78. For synchronous removal of vacuum with relation to the indexing movement of the Geneva gear 84 and with the closing of the canister arms 146 and 148, the valve 232 is actuated by plunger 234 upon the rotation of mechanism drive shaft 110.

The shaft 110 above upper plate 76 also drives microswitch cam 240 (FIG. 4) which causes plunger 242 to operate microswitch 244 adjacent thereto. The microswitch is adapted to engage or disengage the clutch/-brake unit 56 during selected portions of the cycle.

Shaft 110 also drives the spout-inserting mechanism which is only partially shown but is substantially identical with the mechanism described in U.S. Pat. No. 3,690,223. This mechanism includes a support bracket 250 suspended from the lower plate 78 and having a guide for a continuous strip 72 of spout blanks each of which is shaped to provide the body portion and the side wings of a finished spout. The strip is fed through a guideway step-by-step and at the upper end of the guideway is a spout-forming mechanism including a plurality of coacting dies to shape the spout wings and the prongs. At the upper end of the guideway the leading spout is severed from the strip and pushed by a ram through a channel into the predetermined portion of the wall of the canister which at that moment is being held stationary on the canister carrier during a period of rest thereof. The dies and ram are actuated by a cam system mounted on the shaft 110 and just prior to the pushing of the spout flanges through the canister wall, an anvil is inserted into the canister through the open upper end thereof close to the wall to support said wall and receive the thrust of the spout-inserting ram.

The anvil is operated in timed relation to the spout-inserting mechanism by a barrel cam 112 (FIG. 4) carried by the shaft 110 and in whose groove rides a follower roller 258 on one end of a lever 114 that is pivoted at 262 on a bracket 264 that is mounted on the lower frame plate 78. The other end of the lever has a pin and slot connection with an anvil bar or mandrel 116 that is slidably mounted in a guide 268. The anvil bar projects downwardly through an opening in the frame plate and carries an anvil block 270. The face of the anvil block corresponds in size and shape to the body portion of the spout and preferably has depressions therein to deflect the prongs of the spout and facilitate clinching thereof on the canister wall as the spout flanges are pushed through the wall. After completion of the insertion of the spout, the anvil is withdrawn from the canister body.

The labeling assembly, while not shown in detail herein, is substantially identical in structure and operation to the spout-inserting anvil in that the mechanism therefor includes a barrel cam, a cam follower, a lever, a mandrel and a guide. The labeling assembly also similarly operates in timed relation to the spout-inserting mechanism.

In FIG. 8, a no canister/no spout assembly is illustrated in detail. The no canister/no spout assembly includes photoelectric control unit 66 suspended from lower plate 78 for providing a lightbeam to a retroreflector mirror 68. The mirror is positioned on the mechanism bracket so as to be aligned with the lightbeam and so that, when a canister is at the spout-inserting station 36, the lightbeam is interrupted. In cooperative functional relationship with the photelectric control unit by circuit means is solenoid 238 which is de-energized as long as the lightbeam is interrupted. Upon energization, the solenoid is actuated and is adapted to prevent operation of the spout blank feed contact bar described in detail below.

Referring now to FIGS. 9 through 14, beneath and in alignment with the anvil is a rectangular opening 272 in a ram housing plate 274 and beneath the ram housing plate and in line with said opening is a fixed die 276 and a reciprocable ram 278 which, with the removable die 280 is connected to and moved by a support block 282 that is reciprocable mounted and actuated by rollers 284 on the support block that follows a cam 286 mounted on a drive shaft 110 that is journaled in the upper plate 76.

As shown, preferably the fixed die 276 is formed at one end of a plate 288 that also serves as a part of the spout blank strip feed mechanism generally designated 290. Pivoted at one end of the plate 288 opposite the fixed die 276 on a pivot pin 292 is a stripper plate 294 that with the plate 288 provides a guideway 296 for the spout blank strip 72 and is normally biased away from the plate 288 and carries a leaf spring 298 which serves to yieldingly press the blank stip against the underside of the plate 288 and hold the strip against movement. Adjacent the end of the stripper plate opposite its pivot pin 292 is a plunger 300 slideably mounted in a guide recess 302 in the movable die block and normally influenced against the stripper plate by a compression spring 304 that is held in position by a guide rod 306 one end of which is connected to the plunger 300 while the other end is slideably mounted in the support block 282.

During operation of the machine, a spout blank strip 72 is fed step-by-step from a suitable supply such as a reel 70 journaled on the reel bracket frame to the dies and the ram. This strip of spout blanks is shown as including a plurality of spout blanks connected in end-to-end relation, each blank being shaped to provide the body portion 308 and side wings 310 of the finished spout 312.

The strip of blanks is fed by a mechanism comprising a lever 314 pivotally mounted intermediate its ends at 316 on a bracket arm 318 connected to a frame bar 320 secured to the housing plate. Pivotally connected to the end of the lever 314 on a common pivot pin 321 are a pair of feed dogs 322 the upper ends of which have inturned fingers 323 to engage behind the edges of the respective blanks of the blank strip. The Feed dogs are normally influenced into feeding relation to the blank stip by a tension spring 324 one end of which is connected to a pin 326 on the feed dogs while the other end is connected to a screw 328 secured in the lever 314. Preferably an adjustable stop screw 330 is threaded into one of the dogs to abut another screw 332 coaxial with the screw 328 for limiting movement of the feed dogs in one direction under the influence of the spring 324.

The lever 314 is actuated by a feed cam 334 adjustable on the drive shaft 110 and followed by a follower roller 336 journaled on the lever 314. The roller 336 is normally held in contact with the cam by a spring 338 one end of which is connected to the screw 328 while its other end is connected to an arm 340 rigidly connected to the lever 314.

Figure 11:
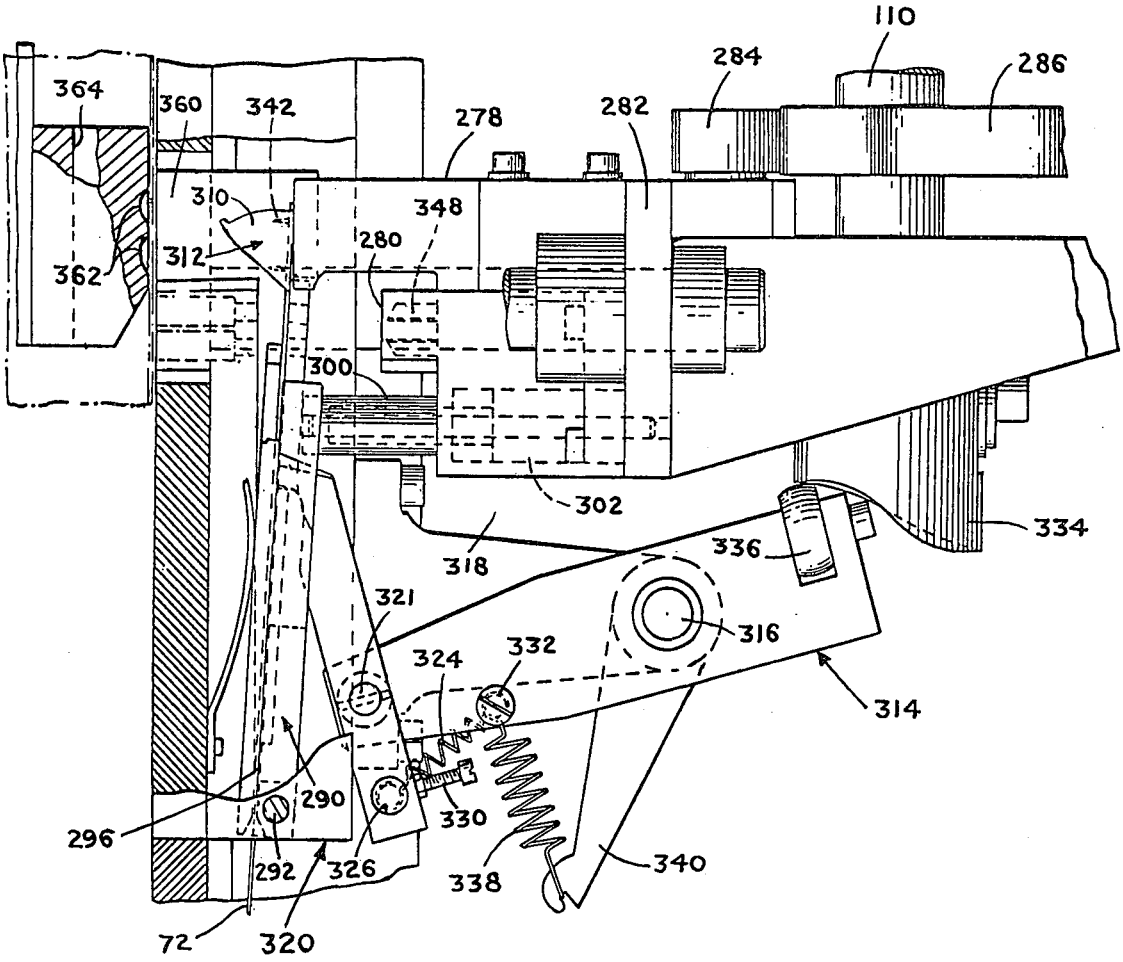
FIG. 11 is an enlarged fragmentary side elevation of the dies, the ram and the driving devices therefor, showing the movable die and ram in retracted position.
Figures 12, 14:
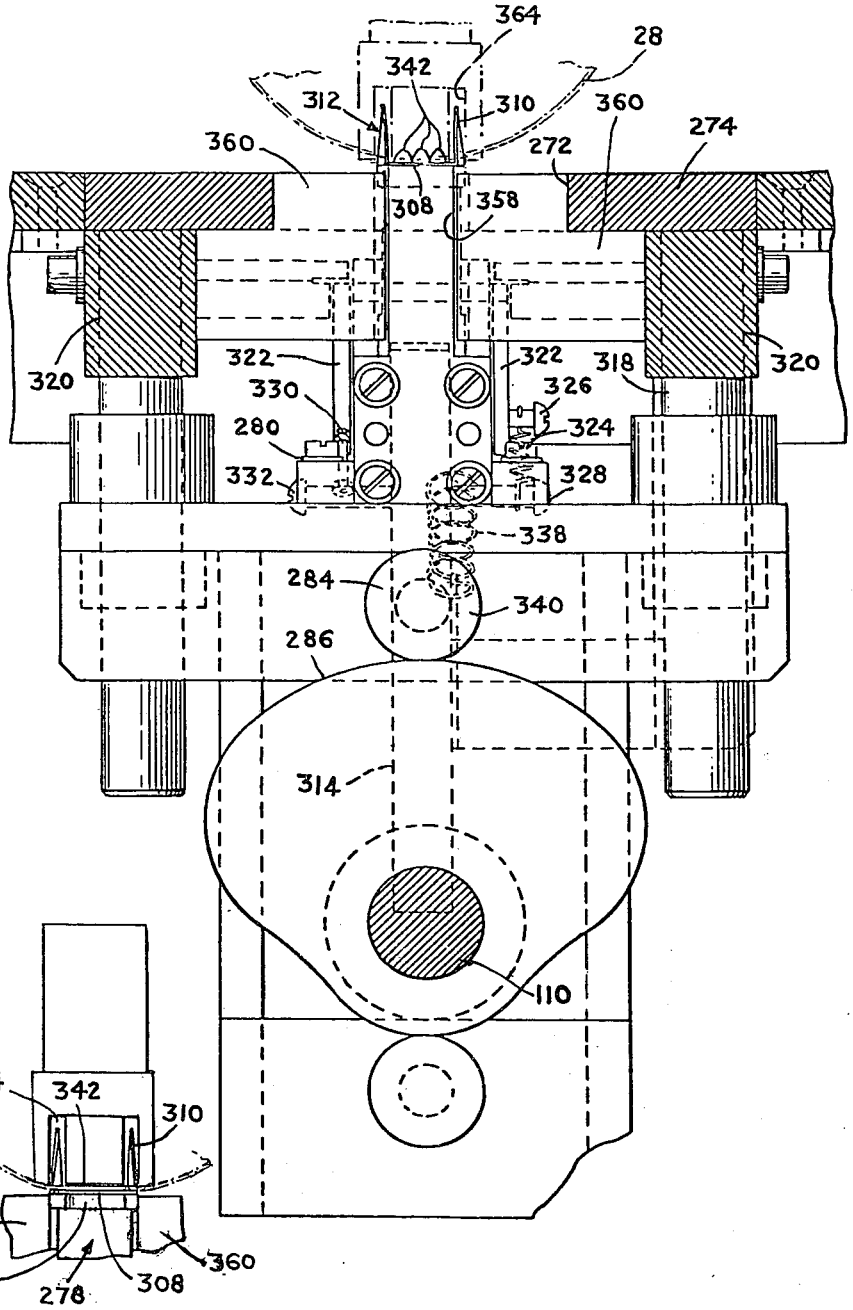
FIG. 12 is a horizontal sectional view taken along line 12—12 of FIG. 10.
FIG. 14 is a fragmentary sectional view through the container and showing the ram and anvil of the machine in end elevation.

During operation of the machine, the canister 28 is positioned in the canister arms of canister plate 134 and anvil block 270 is reciprocally brought downwards behind the canister wall by the action of barrel cam 112. The lever 314 is actuated by the cam 334 to reciprocate the feed dogs 322 and feed the blank strip 72 step-by-step so that at the end of each step a blank is brought onto position between the dies 276 and 278 for completing the formation of the spout, and a completed spout 312 is positioned with respect to the anvil. While the spout blank is at rest, the cam 286 moves the support block 282 to move the lower die 280 into coactive relation to the upper die 276 to complete the spout by bending the wings 310 upwardly from the body portion 308 and by forming prongs 342 for fastening the spout to the canister wall. The lowerside is formed with a channel 344 which coacts with a forming block 346 on the upper die for producing the wings, and the prongs 342 are formed by punches 348 secured in the lower die, which pass loosely through openings 350 in the stripper plate 294 and into die holes 352. The support block 282 is then pushed by the cam 286 so that the punches 348 are withdrawn from the spout, blank and the stripper plate which strips the spout from the punches, and the blank strips 72 are permitted to swing away from the upper die as shown in FIG. 11.

Simultaneously with the formation of one spout, the ram 278 is moved, and the next preceding spout, that is, the spout at the leading end of the strip is severed from the strip between blade edges 354 and 356 that are carried by the ram and the upper die, respectively. After severing the spout from the strip, the ram pushes the spout through a guide channel formed by the fixed die and the spaced apart end surfaces 358 of guide blocks 360. The ram forces the wings and prongs of the spout through the wall of canister 28 which is pressed against the anvil 270. The face of the anvil preferably has depressions 362 to deflect and clinch the prongs. The anvil, of course, has grooves 364 to provide a clearance for the flanges as the latter penetrate the wall of the canister. After the spout has been inserted into and secured in the canister, the anvil 270 is withdrawn from the canister as described above.

Operation of the Canister Registration Device

The registration device associated with the pouring spout insertion machine has a mechanically controlled elevator and vacuum system that are operative in timed relation with the sensing of a registration mark on the canister by an optical scanner. During operation, the canister is moved to various work stations on the canister platform and, at one of these stations, registration is accomplished. The Geneva-drive mechanism provides a dwell time at all work stations which is sufficient for the registration process. Each canister transported through the work stations by an assembly of paired canister arms, normally biased toward each other, so as to grasp the canister. The arm assemblies are controlled by a stationary cam and by a rotating shaft cam, each contoured to coact with a cam follower on one of the arms of the pair to overcome the normally closed spring biasing of the arm during the registration procedure, the rotating shaft cam coacts with and opens the arm assemblies, dropping the canister onto a rotating suction cup provided with a vacuum supply, which cup is driven by a ratio motor through a clutch-brake.

The indexing sequence then continues under the control of the optical scanner. The registration mark on the canister is sensed by the scanner producing a signal to the control unit which causes the clutch to disengage from the ratio motor drive while the brake halts the rotation of the suction cup. As the end of the dwell time at the indexing station approaches, the rocker arm of the canister elevator which is synchronized with the Geneva movement returns the canister to the canister platform level and the rotation of the shaft cam allows the springs in the arm assembly to close the arms about the canister. Either before or after the positioned canister is recaptured by the arms, the vacuum supply is interrupted, the Geneva movement indexes the canister to the next work station, and the clutch brake unit reengages the ratio motor prior to arrival of the next successive canister for registration.

Figure 15:
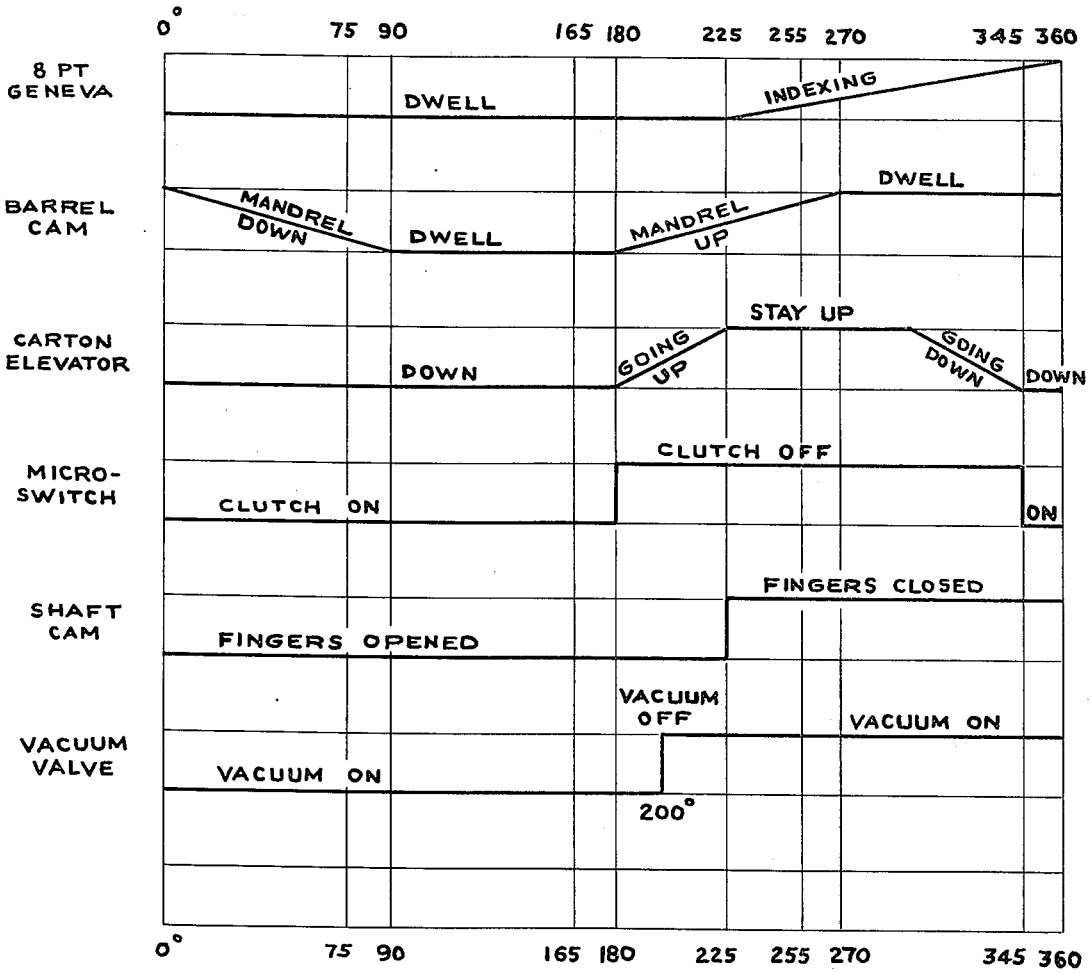
FIG. 15 is a timing diagram showing the sequence of operation of the spout-inserting machine.

Referring now to FIG. 15, the operation of the registration device is described in its timed relation to the spout-insertion mechanism. The 8-point Geneva mechanism establishes the basic division of time between dwell time and indexing time. Substantially all spout insertion, registration and labeling functions need to be accomplished during dwell time so that all operating equipment is clear of the moving canisters during indexing; however, some preparatory functions, such as lowering the carton or canister elevator below the suction cup, resetting the microswitch controlling the ratio motor start-up and re-applying the vacuum, are performed during the indexing time.

The timing diagram sets forth the relationship of the shaft cam operation to the other functions. If the shaft cam is viewed as an overriding control to a normal "fingers closed" condition at the registration work station, the coincidence between control change from "fingers opened" "fingers closed" and the onset of indexing is clearly dictated by the necessity of maintaining the rotational alignment of a canister being moved from one work station to the next. Similarly, when the shaft cam is causing the canister arms to close, the canister is being moved by the elevator to the turntable level and the vacuum is momentarily released (see "carton elevator" and "vacuum valve" timing lines).

Figure 16:
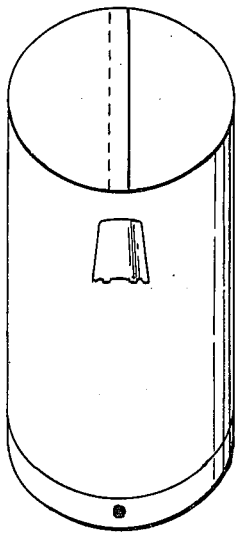
FIG. 16 is a perspective view of a canister with an index registration mark thereon.

While numerous workpieces may be used with a variety of index marks thereon, FIG. 16 shows a typical arrangement used herein. The canister is shown with an indexing mark on the lowermost portion thereof for sensing by the registration detector unit. Although shown opposite the seam of the canister, the placement of the indexing mark is independent of the printing registration between the seam and the graphic display on the canister.

While a single embodiment is shown herein with cam-operated mechanisms working in timed relation with each other, it should be understood that the invention may be more broadly utilized in the packaging art.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. A machine for mounting a pouring spout at a predetermined position on the wall of a canister comprising:

carriage means for intermittently moving in one direction a canister on a continuous path having a plurality of work stations;

first holding means for releasably holding said canister on said carriage, said holding means operable between an open position and a closed position;

detection means for sensing an indexing mark and for providing a control signal in response thereto, said detection means disposed adjacent a first one of said work stations;

registration means for rotation of a canister with first holding means at said open position, said rotation at said first work station to present an indexing mark on a canister to said detection means, said registration means responsive to said control signal by stopping said rotation of said canisters;

a carrier adjacent a second one of said work stations for supporting a pouring spout and for sequentially presenting a spout to a predetermined portion of a canister wall; and a ram reciprocally operable toward and away from a canister wall to push a spout portion through said canister wall and withdraw from the spout respectively; and said sequencing means coacting with said first holding means to open said first holding means to receive said canister, to close said first holding means for transporting said canister to said first work station, to open said canister at said first work station for rotation of said canister, to close said first holding means after rotation of said canister for movement of said canister through the remainder of said plurality of work stations while holding said canister in a fixed angular orientation with relation to said plurality of work stations, and opening said first holding means to release said canister at the end of said continuous path having a plurality of work stations.

2. A machine for mounting a pouring spout at a predetermined position on the wall of a canister comprising:

carriage means for intermittently moving in one direction a canister on a continuous path having a plurality of work stations;

first holding means for releasably holding said canister on said carriage, said holding means operable between an open position and a closed position;

detection means for sensing an indexing mark and for providing a control signal in response thereto, said detection means disposed adjacent a first one of said work stations;

registration means for rotation of a canister with first holding means at said open position, said rotation at said first work station to present an indexing mark on a canister to said detection means, said registration means responsive to said control signal by stopping said rotation of said canister;

sequencing means for returning said first holding means to said closed position upon the stopping of said registration means;

a carrier adjacent a second one of said work stations for supporting a pouring spout and for sequentially presenting a spout to a predetermined portion of a canister wall; and a ram reciprocally operable toward and away from a canister wall to push a spout portion through said canister wall and withdraw from the spout respectively; and said registration means further comprise:

a rotatable member adjacent and below said first work station for receiving a canister released thereat:

a second holding means for releasably holding said canister to said totatable member during rotation of said member; and a canister elevator adjacent said rotatable member for moving a canister after rotation thereof to the position prior to release by said second holding means.

3. A machine as described in claim 2, wherein said carriage means further comprise:

a turntable horizontally supported and movable intermittently on an arcuate path, said work stations adjacent the perimeter of the turntable; and a stationary cam to position said first holding means at said open position and at said closed position for each of said work stations.

4. A machine as described in claim 3, wherein said first holding means comprises:

a pair of arms at each work station pivotally mounted on said turntable for releasably holding said canister, each of said pair of arms movable to successive work stations;

biasing means attached to said pair of arms for urging one of said pair of arms toward the other of said pair of arms to hold securely the canister therebetween; and cam following means attached to at least one of said pair of arms for tracing the stationary cam and thereby causing said pair of arms to be urged to the open position and the closed position.

5. A machine as described in claim 4, further comprising an anvil mounted adjacent said second work station, said anvil reciprocally movable into and out of a canister for coaction with the ram upon mounting a pouring spout at the predetermined passage of a canister wall and for allowing passage of a canister to the next one of said work stations respectively.

6. A machine as described in claim 5, further comprising:

a spout-forming mechanism mounted adjacent said carrier for cooperative functioning therewith comprising:

a support adapted to hold a plurality of spout blanks connected one to the other to form a continuous strip thereof;

feeding means for receiving a strip of blanks successively and for presenting the blanks to the spout-forming mechanism; and at least one die means mounted adjacent said feeding means for severing spout blanks from a continuous strip, forming side flanges of the body of a pouring spout, and forming prongs therethrough for attaching a spout to a canister wall;

a guideway communicating between said die means and said carrier for providing formed pouring spouts to a canister; and release means in said guideway for selectively blocking and clearing the guideway to prevent and permit the passage of a formed pouring spout respectively to the carrier.

7. A machine as described in claim 6, wherein said anvil includes a mandrel to be inserted inside a canister with a surface in abutting juxtaposition to a canister wall, said mandrel surface having recesses to receive prongs, said recesses being formed to bend prongs upon the wall of a canister as the prongs are thrust against the recesses by the movement of said ram.

8. A machine as described in claim 6 wherein said release means is control responsive to a sensor detecting the absence of a canister at said second work station.

9. A machine as described in claim 8 wherein said sensor is a photoelectric unit with a retroreflective mirror, said sensor, when a normally interrupted lightbeam is reflected back to the photoelectric unit, operative to arrest the movement of said release means.

10. A pouring spout inserting machine comprising:

a carriage for supporting and moving a plurality of canisters that have indexing marks thereon;

holding means connected with said carriage for holding and releasing said canister on said carriage;

first drive means for intermittently moving said carriage in one direction through a predetermined path having a plurality of spaced work stations: said drive means operative for sequentially moving a canister from one of said work stations to the next of said work stations and then dwelling at said work station for a predetermined time;

a registration device support adjacent a first one of said work stations;

receiving means mounted on said registration device support for supporting a canister during a portion of said predetermined dwell time;

second drive means for rotating said receiving means and for stopping said rotation within a fixed angular displacement of a canister;

spout forming and feeding mechanism disposed at a second one of said work stations at one side of said path, including means for feeding a flat strip of spout blanks step-by-step, forming means for shaping spout blanks into spouts, a mechanism in said path for severing spouts from a strip and inserting them into a predetermined portion of a canister during the cessation of movement of said drive means;

a carrier adjacent said second one of said work stations for supporting a pouring spout and for sequentially presenting a spout to a predetermined portion of a canister wall; and a ram reciprocally operable toward and away from said canister wall to push said side flanges through said canister wall and withdraw from the spout respectively; and sequencing means coacting with said holding means for holding said canister while said carriage moves said canister to said first work station, releasing said canister during rotation thereof by said second drive means, and holding said canister in fixed angular relation to said carriage as said canister travels through said path having a plurality of spaced work stations.

11. A machine as described in claim 10 further comprising:

detection means at said first one of said work stations for sensing said indexing mark and providing a control signal in response thereto; and a clutch interposed between said receiving means and said second drive means, said clutch member engaging said second drive means initially during said portion of said predetermined time and disengaging said second drive means in response to said control signal for at least the remainder to the predetermined time.

12. A pouring spout inserting machine comprising:

a carriage for supporting and moving a plurality of canisters that have indexing marks thereon:

first drive means for intermittently moving said carriage in one direction through a predetermined path having a plurality of spaced work stations, said drive means operative for sequentially moving a canister from one of said work stations to the next of said work stations and then dwelling at said work stations for a predetermined time;

a registration device support adjacent a first one of said work stations;

receiving means mounted on said registration device support for supporting a canister during a portion of said predetermined dwell time;

second drive means for rotating said receiving means and for stopping said rotation within a fixed angular displacement of a canister;

spout forming and feeding mechanism disposed at a second one of said work stations at one side of said path, including means for feeding a flat strip of spout blanks step-by-step, forming means for shaping spout blanks into spouts, a mechanism in said path for severing spouts from a strip and inserting them into a predetermined portion of a canister during the cessation of movement of said drive means;

detection means at said first one of said working stations for sensing said indexing mark and providing a control signal in response thereto; and a clutch interposed between said receiving means and said second drive means, said clutch member engaging said second drive means initially during said portion of said predetermined time and disengaging said second drive means in response to said control signal for at least the remainder to the predetermined time; and a first holding means, including:

a pair of arms at each work station pivotally mounted on said turntable for releasably holding said canister each of said pair of arms movable to successive work stations;

biasing means attached to said pair of arms for urging one of said pair of arms toward the other of said paid of arms to hold securely the canister therebetween; and cam following means attached to at least one of said pair of arms for tracing the stationary cam and thereby causing said pair of arms to be urged to the open position and the closed position.

13. A machine as described in claim 12 further comprising an anvil mounted adjacent said second work station, said anvil reciprocally movable into and out of a canister for coaction with the ram upon mounting a pouring spout at the predetermined portion of a canister wall and for allowing passage of a canister to the next one of said work stations respectively.

14. The machine described in claim 13 wherein said spout-forming and feeding mechanism further comprises:

at least one die means mounted adjacent said means for feeding and positioning blanks to form side flanges of the pouring spout and for forming prongs from a portion of the central body of a blank for attaching a spout to said canister wall; and a guideway communciating between said die means and said carrier.

15. A machine as described in claim 14 wherein said spout-forming and feeding mechanism includes a release means in said guideway for selectively blocking and clearing the guideway to prevent and permit respectively the passage of a formed pouring spout to the carrier.

16. A machine as described in claim 15 wherein said anvil includes a mandrel to be inserted inside a canister with a surface in abutting juxtaposition to the wall of a canister, said surface having recesses to receive prongs, said recesses being formed to bend prongs upon the wall of a canister as the prongs are thrust against the recesses by the movement of said ram.

17. A machine as described in claim 15 wherein said release means is control responsive to a sensor detecting the absence of a canister at said second work station.

18. A machine as described in claim 17 wherein said sensor is a photoelectric unit with a retroreflective mirror, said sensor, when a normally interrupted lightbeam is reflected back to the photoelectric unit, operative to arrest the movement of said release means.

19. A machine for mounting a pouring spout at a predetermined position on the wall of a canister comprising:

carriage means for intermittently moving a canister through a sequence of work stations;

first holding means on said carriage operable between an open and a closed position;

carriage drive means to move said carriage means;

registration means at a first one of said work stations for rotating a canister with said first holding means at said open position, said registration means responsive to control signal to stop rotation of a canister;

detection means operatively disposed at said first work station adapted to sens indexing indicia on a canister and provide a control signal in response thereto to stop rotation of said registration means;

a carrier adjacent a second one of said work stations for supporting a pouring spout and for sequentially presenting a spout to a predetermined portion of a canister wall;

a ram reciprocally operable toward and away from a canister wall to push a spout through said canister wall and withdraw from the spout respectively; and sequencing means coacting with said first holding means for opening said first holding means to receive said canister, closing said first holding means to move said canister to said first work station, opening said holding means at said first work station to allow rotation of said canister, closing said holding means at said first work station for moving said canister through said sequence of work stations while holding said canister in fixed angular relation to said carriage.

20. A machine for indexing an object comprosing:

carriage means for intermittently moving an object through a sequence of work stations;

first holding means on said carriage operable between an open and a closed position;

carriage drive means to move said carriage;

registration means at a first one of said work stations for rotating an object with said first holding means at said open position, said registration means responsive to a control signal to stop rotation of an object;

second holding means operatively associated with said registration means to releasably hold said object on said registration means;

detection means operatively deposed at said first work station adapted to sense indexing indicia on a canister and provide a control signal in response thereto to stop rotation of said registration means;

sequencing means for opening said second holding means and closing said first holding means after stopping said registration means; and sequencing means coacting with said first holding means for opening said first holding means to receive said canister, closing said first holding means to move said canister to said first work station, opening said holding means at said first work station to allow rotation of said canister, closing and holding means at said first work station for moving said canister through said sequence of work stations while holding said canister in fixed angular relation to said carriage.

* * * * *